US006095893A

United States Patent [19]

Lin

[11] Patent Number: 6,095,893

[45] Date of Patent: Aug. 1, 2000

[54] BRA HAVING AROMATIC CONCENTRATE CELLS RECEIVED THEREIN

[76] Inventor: Hsien-Yih Lin, Suit 16, 6th Fl, No. 183, Hsiao-Ya Road, Chia-I, Taiwan

[21] Appl. No.: 09/348,511

[22] Filed: Jul. 7, 1999

[30] Foreign Application Priority Data

Jul. 17, 1998 [TW] Taiwan ..... 87211575

[51] Int. Cl.[7] ..... A41B 9/00

[52] U.S. Cl. ..... 450/38; 450/1; 450/57

[58] Field of Search ..... 450/1, 37–39, 450/54–57, 30, 31, 32, 89; 239/36, 152, 153, 653; 512/1, 4; 623/7, 8; 2/267, 268, 73, 455–456, 459–467

[56] References Cited

U.S. PATENT DOCUMENTS

| | | | |
|---|---|---|---|
| 5,782,671 | 7/1998 | Suen et al. | 450/38 |
| 5,823,852 | 10/1998 | Chu | 450/38 |
| 5,899,790 | 5/1999 | Berg | 450/1 |
| 5,944,578 | 8/1999 | Lin et al. | 450/57 |

*Primary Examiner*—Gloria Hale
*Attorney, Agent, or Firm*—Rosenberg, Klein & Lee

[57] ABSTRACT

A bra includes two cups and two cells are respectively received in the two cup and located between an inner lining and an outer layer of each cup. The cells are made of air-permeable material and oil, body lotion and aromatic concentrate are received in each cell so that when wearing the bra, the oil will massage the breasts and the aromatic concentrate and the body lotion will be vaporized to gently stimulate the vessels in the breasts.

2 Claims, 5 Drawing Sheets

BRA HAVING AROMATIC CONCENTRATE CELLS RECEIVED THEREIN

FIELD OF THE INVENTION

The present invention relates to a bra and each cup of the bra has a cell received therein. Each cell is made of air-permeable material and aromatic concentrate is received in the cell.

BACKGROUND OF THE INVENTION

A conventional bar having two cups and each cup has an inner lining and an outer layer, wherein the inner lining is made of soft material and the outer layer is made of durable material. The two cups of the bra support the breasts of the wearer. Nevertheless, customers require additional functions for the bra not only supporting the breasts. The requirements from the customers are various such as a bra which concentrates and lifts the breasts, or a bra which has changeable shoulder straps. In other words, the conventional bra can only provide a basic feature to support the breasts.

The present invention intends to provide a bra which can massage the breasts and provide aromatic concentrate vapor to gently stimulate the vessels in the breasts. The bra of the present invention provides an additional function to the breasts and which is helpful for the health of the wearer.

SUMMARY OF THE INVENTION

In accordance with one aspect of the present invention, there is provided a bra comprising two cups and each cup including an inner lining and an outer layer. Two cells made of air-permeable material and each cell receives body lotion and oil. The body lotion is vaporable lotion and each cell is received between the inner lining and the outer layer of the cup.

The primary object of the present invention is to provide a bra having a cell received in each cup of the bra and the cell has aromatic concentrate, oil and body lotion received therein. The cells are made of air-permeable material so that the aromatic concentrate and the body lotion will vaporized and improve the circulation of the blood in the vessels in the breasts.

Another object of the present invention is to provide a bra having a cell in each cup so that the oil in the cells will massage the breasts of the bra wearer.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
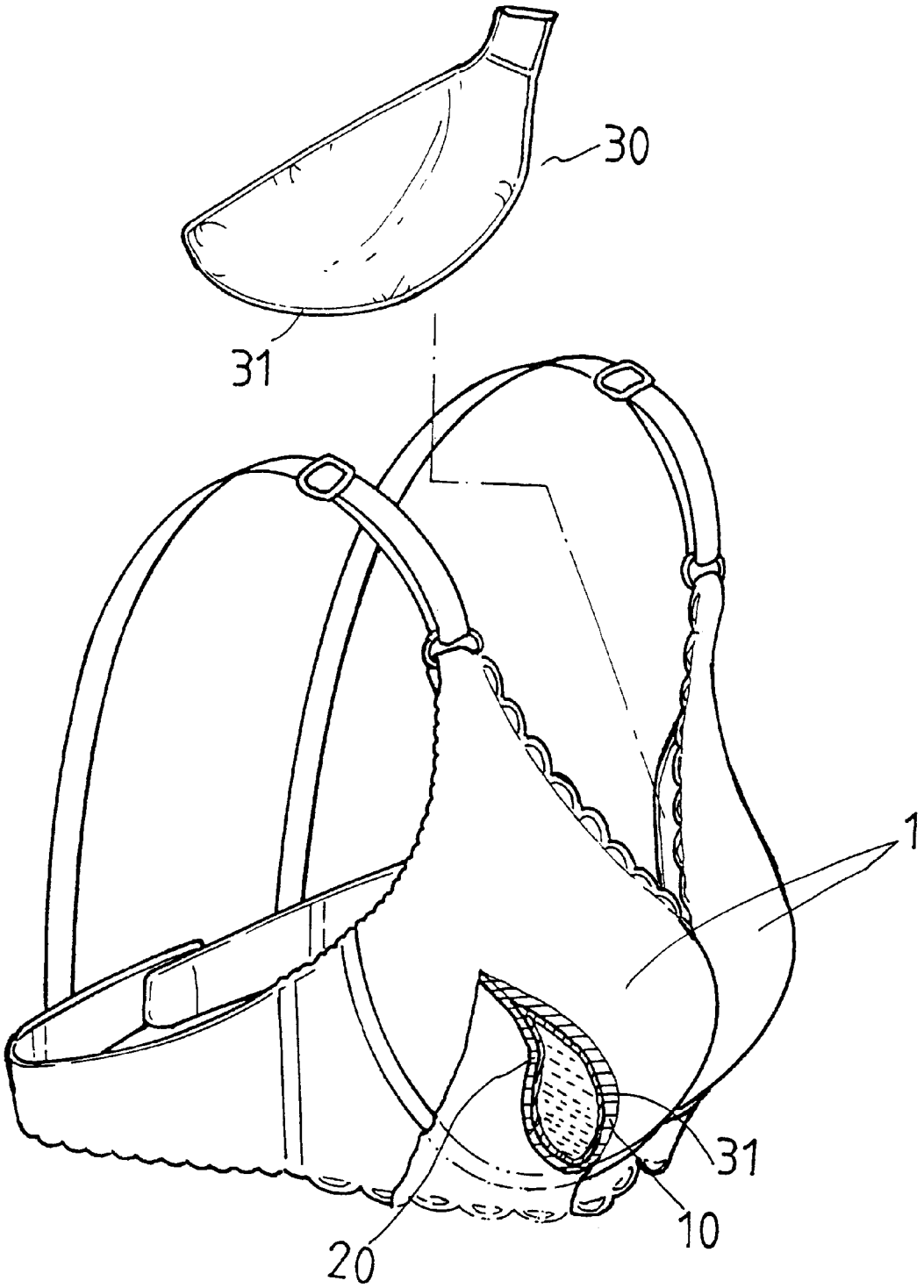
FIG. 1 is an exploded view of the bra and a cell in accordance with the present invention.
Figure 2:
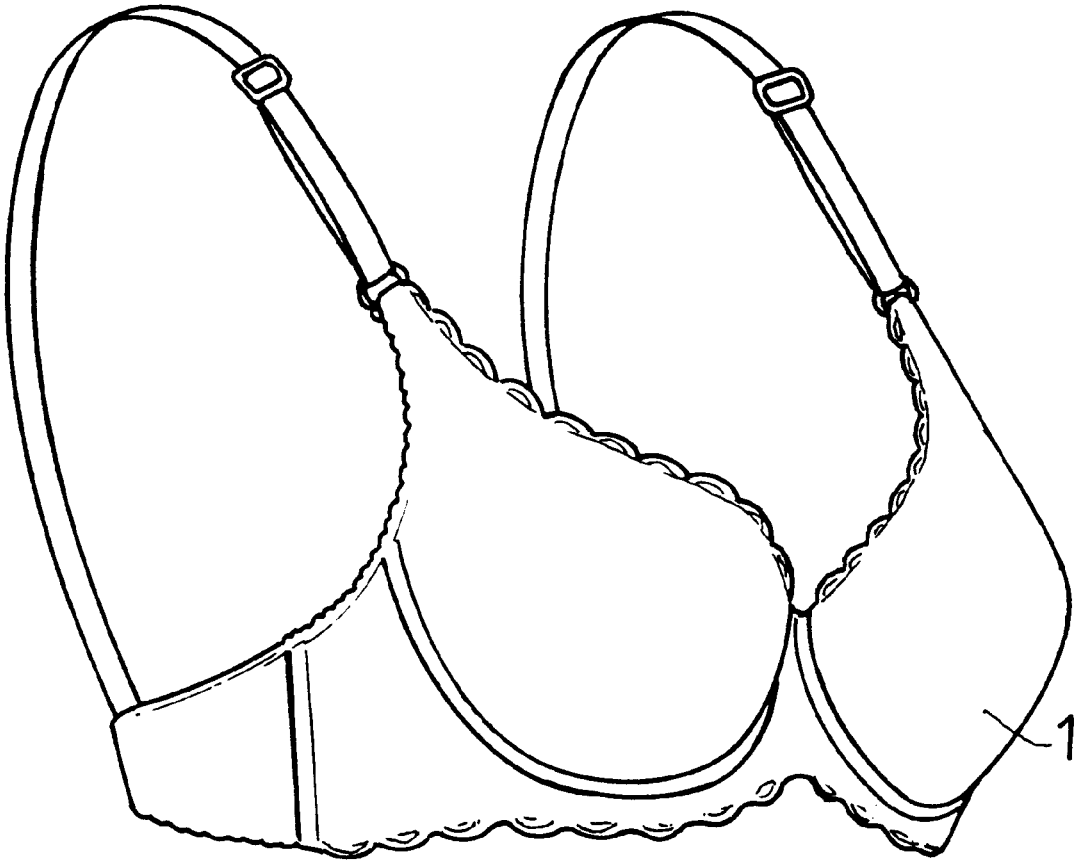
FIG. 2 is a perspective view of the bra in accordance with the present invention.
Figure 3:
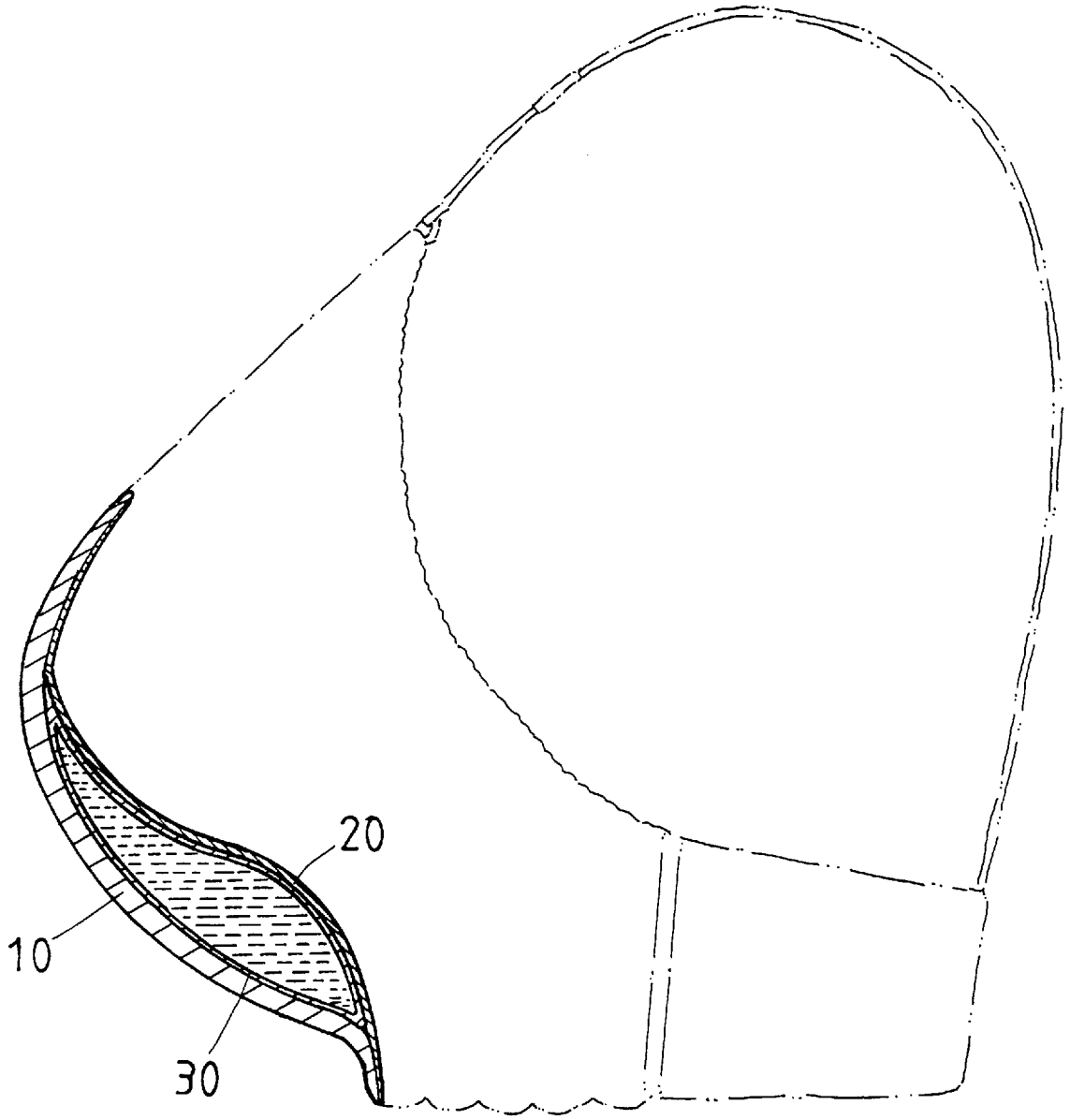
FIG. 3 is a side elevational view, partly in section, of the bra in accordance with the present invention.

For a better understanding of the present invention, reference is made to FIGS. 1 to 3 and 5, the bra in accordance with the present invention comprises two cups (1) and each cup (1) includes an inner lining (20) made of soft material such as cotton, and an outer layer (10) which is made of durable material such as nylon.

Two cells (30) made of air-permeable material (31) and each cell (30) receives body lotion, aromatic concentrate and oil. The body lotion and the aromatic are vaporable so that they will be vaporized by the body temperature. Each cell (30) is received between the inner lining (20) and the outer layer (10) of the cup (1).

Figure 4:
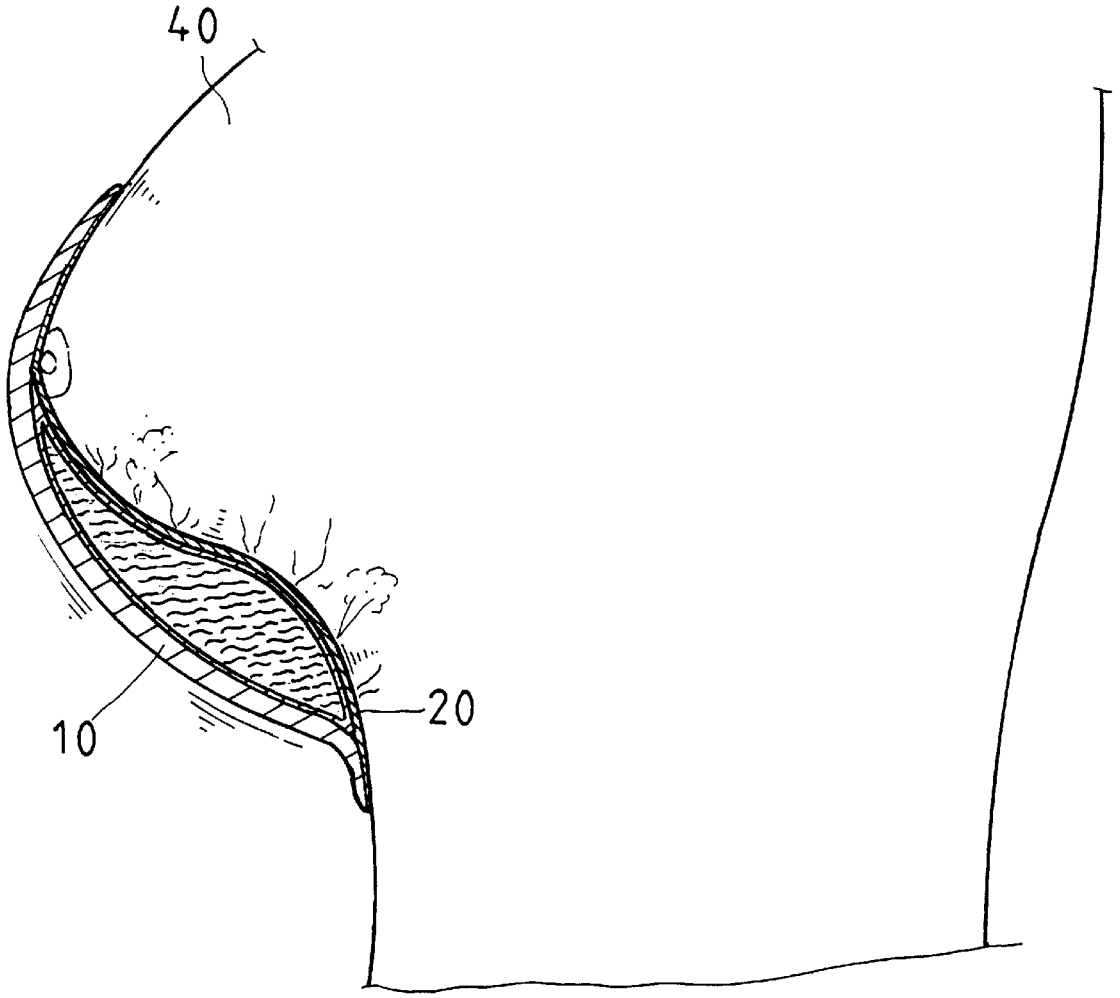
FIG. 4 is an illustrative view to show the aromatic concentrate and the body lotion in the cells are vaporized and the vapor contacts the breast.
Figure 5:
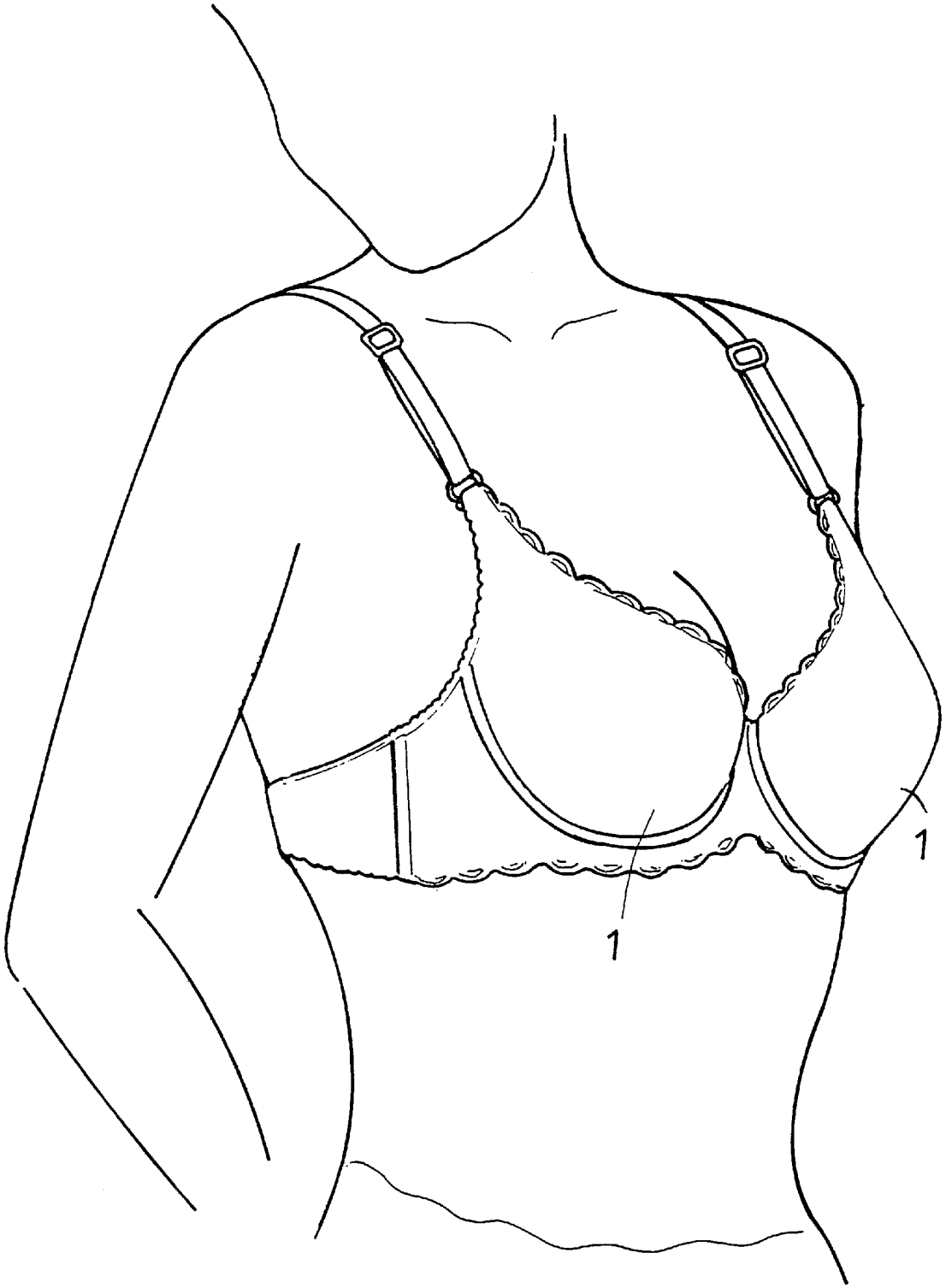
FIG. 5 is a perspective view of a wearer wearing the bra in accordance with the present invention.

Referring to FIG. 4, when a wearer wears the bra, the body lotion and the aromatic are vaporized so that the vapor will pass through the air-permeable material (31) of the cells (30) and the inner linings (20) of the two cups (1) so as to contact the breasts (40) and improve the blood circulation of the vessels in the breasts (40). The oil in the cells (30) is liquid at the body temperature so that when the wearer walks or moves, the oil will massage the breasts (40).

While we have shown and described various embodiments in accordance with the present invention, it should be clear to those skilled in the art that further embodiments may be made without departing from the scope and spirit of the present invention.

What is claimed is:

1. A bra comprising:

two cups (1) and each cup (1) including an inner lining (20) and an outer layer (10), and two cells (30) made of air-permeable material (31) and each cell (30) receiving body lotion and oil, the body lotion being vaporable lotion, each cell (30) received between said inner lining (20) and said outer layer (10) of said cup (1).

2. The bra as claimed in claim 1 further comprising aromatic concentrate in said cells (30).

* * * * *